US005963120A

United States Patent [19]

Zaviska

[11] Patent Number: 5,963,120

[45] Date of Patent: Oct. 5, 1999

[54] COIL SUPPORT

[75] Inventor: Dalibor Zaviska, Rochester, Mich.

[73] Assignee: ITT Manufacturing Enterprises Inc., Wilmington, Del.

[21] Appl. No.: 09/011,274

[22] PCT Filed: Jul. 26, 1996

[86] PCT No.: PCT/EP96/03304

§ 371 Date: May 1, 1998

§ 102(e) Date: May 1, 1998

[87] PCT Pub. No.: WO97/07516

PCT Pub. Date: Feb. 27, 1997

[30] Foreign Application Priority Data

Aug. 12, 1995 [DE] Germany ..... 195 29 725

[51] Int. Cl.[6] ..... H01F 27/30

[52] U.S. Cl. ..... 336/208; 336/225

[58] Field of Search ..... 336/198, 208, 336/185, 225; 335/250

[56] References Cited

U.S. PATENT DOCUMENTS 3,389,355 6/1968 Schroeder .

4,473,811 9/1984 Schauble .

FOREIGN PATENT DOCUMENTS

| | | |
|---|---|---|
| 0343497 | 11/1989 | European Pat. Off. . |
| 73.10293 | of 0000 | France . |
| 3428241 | 2/1986 | Germany . |
| 3423180 | 11/1990 | Germany . |
| 9212114 | 2/1994 | Germany . |
| 2148603 | 5/1985 | United Kingdom . |

OTHER PUBLICATIONS

English translation of the International Preliminary Examination Report of Application No. PCT/EP96/03304 filed Jul. 26, 1996.

*Primary Examiner*—Thomas J. Kozma
*Attorney, Agent, or Firm*—Rader, Fishman & Grauer PLLC

[57] ABSTRACT

A coil support for accommodating at least one coil wire of an electromagnet, more particularly for use in electromagnetic valves, includes a hollow-cylinder-shaped support part having ends which are provided with stops defining the coil in its axial position. The support part has a step in its diameter which is limited on both sides by the coil wire with different winding layers and on which the coil wire is guided.

3 Claims, 1 Drawing Sheet

COIL SUPPORT

BACKGROUND OF THE INVENTION

The present invention relates to a coil support for accommodating at least one coil wire of an electromagnet, more particularly for use in electromagnetic valves.

German patent application No. 41 41 546 discloses a coil support for accommodating a coil wire for an electromagnet. The coil support includes a hollow-cylinder-shaped support part having ends which are furnished with disc-shaped stops. The height of the wire coil and the inside and outside diameter is determined by the dimensioning of the support part.

However, it is necessary in special cases of application to be able to vary the number of coil windings by way of the height of the hollow-cylinder-shaped support part without gaps occurring in the winding layers which impair the function.

SUMMARY OF THE INVENTION

This object is achieved by a coil support of the previously mentioned type with a support part which in its diameter has a step which is bounded on both sides by the coil wire with a different number of winding layers and in which step the coil wire is guided.

The present invention will be explained hereinbelow by way of a drawing.

DETAILED DESCRIPTION OF THE DRAWING

Figure 1:
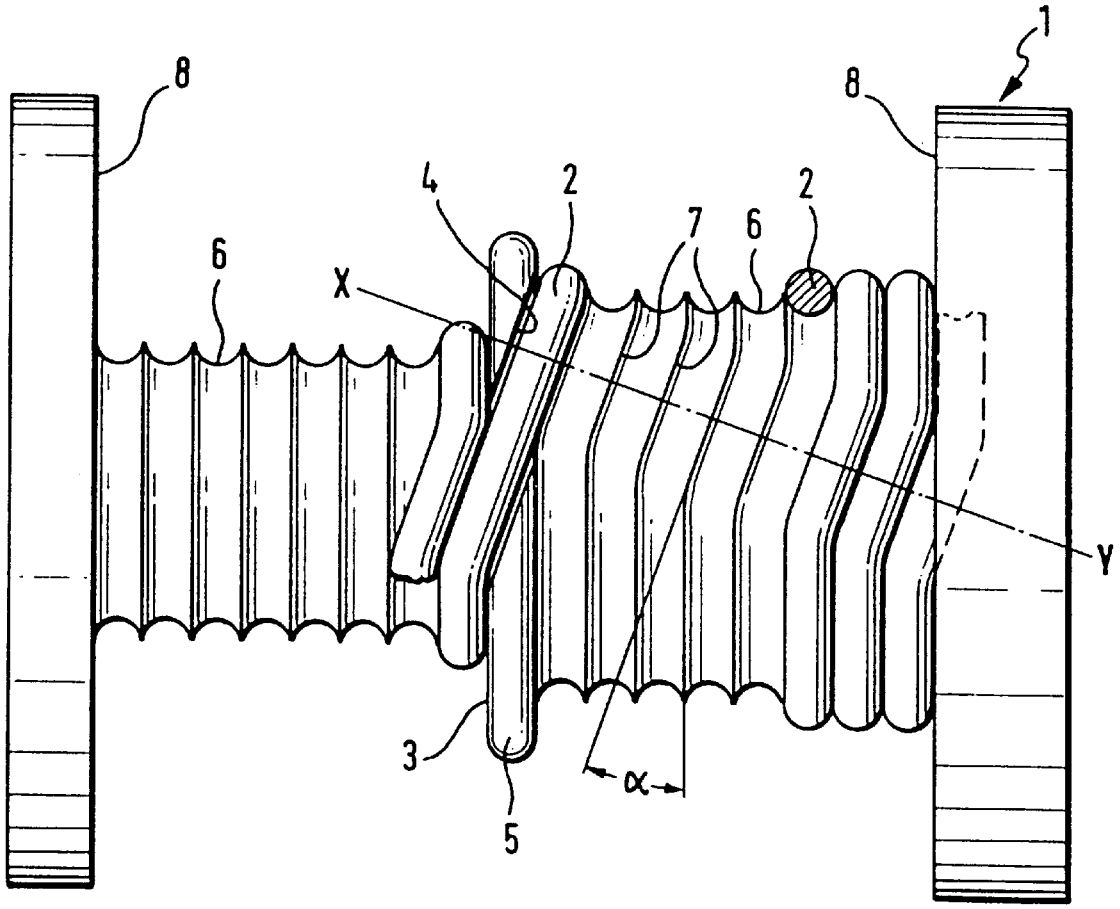
FIG. 1 shows an enlarged view of an embodiment of a coil support which can be used especially on electromagnetic valves.

The coil support according to FIG. 1 comprises a hollow-cylinder-shaped support part 1 having ends which include disc-shaped stops 8 defining the coil in its axial position after the coil wire 2 has been wound up completely. On roughly half the winding length of the coil wire 2, the support part 1 has a step 3 in the outside diameter which is evenly covered by the coil wire 2 after several winding layers when, after filling of the annular grooves 6, the winding layer diameter in the portion of the support part 1 with the smaller outside diameter has reached the large outside diameter. To wind the coil wire 2 up on the support part 1, the step 3 has a recess 4 which guides the coil wire 2 in the winding direction desired. The recess 4 is bounded by a radially circumferential collar 5 on the step 3. The support part 1 includes a number of annular grooves 6 arranged in parallel side by side. On the large outside diameter of the support part 1, several annular grooves 6 arranged side by side have crank portions, each in the form of a groove offset 7, in which the coil wire 2 is deflected laterally during the winding operation. Each groove offset 7 has an angle of deflection alpha identical in size and direction with respect to the respectively adjacent groove offset 7. It can be seen from the drawing that the groove offsets 7 are in alignment relative to each other. Recess 4 on the step 3 is also positioned in the plane of alignment XY of the groove offsets 7. The groove offsets 7 are disposed in the area of the support part having the larger effective diameter. To clarify the constructive design of the support part 1, the drawing exclusively shows a first winding layer of the coil wire 2 in a section. The drawing shows that the coil wire 2 is forced to follow the change in direction on the support part 1 in the area of the groove offset 7 pointing laterally to the longitudinal coil axis. Thus, with an increasing number of windings of the coil wire 2, along the annular grooves 6, there is a parallel alignment in the same direction over the longitudinal axis of the support part 1. This ensures reliably guiding the coil wire 2 even with small layer tolerances of the coil wire on the support part 1 and a relatively narrow recess 4 on the step 3. Even with different diameters of the coil wire 2 and/or different tensile forces of the wire during the winding action, the disclosed invention permits guiding the coil wire 2 directly to the recess 4 so that a uniform winding thickness of the coil wire 2 is ensured over all winding layers in the area of the step 3. The collar 5 supports the guiding operation and, thus, the deflection of the coil wire 2 in the direction of the support part 1 having the smaller outside diameter because the collar 5 in the area of the recess 4 also has lateral guide slopes which are aligned equivalently to the groove offset 7. Therefore, it is important for the subject matter of the present invention that a deflection of the coil wire 2 continuously in the direction of the recess 4 occurs already at the commencement of the winding action on the larger nominal diameter of the support part 1 in order to achieve evenly wound coil wires 2 over almost all winding layers. The uniform guiding of the coil wires 2 and the annular grooves 6 along the plane of alignment XY can clearly be seen in the embodiment of FIG. 1. The plane of alignment extends at an acute angle relative to the longitudinal support axis in the direction of the recess 4. Thus, all annular grooves 6 have an even groove offset 7 which is depicted graphically by the angle of deflection alpha and characterizes the deviation (offset) of a radially circumferential groove on the support part 1 relative to the transverse axis of the support part 1.

I claim:

1. A coil support for accommodating at least one coil wire of an electromagnetic coil, including a hollow-cylinder-shaped support part including a large number of annular grooves arranged in parallel side by side and having ends which are provided with stops defining the coil in its axial position, the support part having a diameter with a step which is bounded by the coil wire with different winding layers and on which the coil wire is guided, including a recess on the step in which the coil wire is guided, and including a radially circumferential collar on the step which bounds the recess, wherein a plurality of annular grooves arranged adjacently side by side include crank portions, each configured as a groove offset, with the result that the coil wire is deflected laterally, wherein each groove offset has an angle of deflection identical in size and direction with respect to the closest adjacent groove offset, and wherein the groove offsets are in alignment to each other.

2. The coil support as claimed in claim 1, wherein the recess is positioned in a plane of alignment of several groove offsets.

3. The coil support as claimed in claim 1, wherein the annular groove along with the groove offset is arranged on the support part in an area of a larger outside diameter.

* * * * *